United States Patent [19]

Shiojima et al.

[11] Patent Number: 4,957,196

[45] Date of Patent: Sep. 18, 1990

[54] COIN-OPERATED LOCKER

[75] Inventors: Kenji Shiojima; Yuji Kasai, both of Tokyo, Japan

[73] Assignee: Kokusan Kinzoku Kogyo Kabushiki Kaisha, Tokyo, Japan

[21] Appl. No.: 285,935

[22] Filed: Dec. 19, 1988

[30] Foreign Application Priority Data

Dec. 28, 1987 [JP] Japan ..... 62-330026

[51] Int. Cl.[5] ..... G07F 17/12

[52] U.S. Cl. ..... 194/239; 70/DIG. 41

[58] Field of Search ..... 194/202, 239, 240, 241, 194/242, 244, 245, 246, 350; 70/DIG. 41

[56] References Cited

U.S. PATENT DOCUMENTS 2,703,973 3/1955 Fawcett ..... 194/241 X

FOREIGN PATENT DOCUMENTS 1149559 5/1963 Fed. Rep. of Germany ..... 194/239

2726908 8/1978 Fed. Rep. of Germany ..... 194/239

2938398 4/1981 Fed. Rep. of Germany ..... 194/242

0052698 4/1977 Japan ..... 194/242

0052699 4/1977 Japan ..... 194/242

0207198 12/1983 Japan .

*Primary Examiner*—F. J. Bartuska

*Attorney, Agent, or Firm*—Schwartz & Weinrieb

[57] ABSTRACT

A coin-operated locker which is impossible to be opened when the locker is unused and which is openable by means of its door and becomes usable when a coin or coins of a predetermined amount are deposited, includes a sensor for detecting the deposit of a coin or coins, a detector for detecting the locking and the unlocking of a cylinder lock, a plunger engageable with or removable from an engaging opening of the door, and a controller for retracting the plunger from the door in response to a coin deposit signal from the sensor and for engaging the plunger with the door after a predetermined time in response to an unlock signal from the detector.

7 Claims, 9 Drawing Sheets

COIN-OPERATED LOCKER

FIELD OF THE INVENTION

This invention relates to a coin-operated locker which can prevent the wrongful use thereof constituting the storage of an unnecessary article or the like within the locker at no charge by preventing the door of the locker from being opened when the locker is attempted to be unrighteously used and enabling the door to be opened and the locker to be used when a predetermined coin or coins are deposited within the locker lock mechanism.

DESCRIPTION OF THE PRIOR ART

A coin-operated locker is disposed in a door openable state by unlocking its door when the locker is not used. When a coin or coins of a predetermined amount are deposited within the locker lock mechanism, a key inserted within the locker cylinder lock is allowed to be turned, a locking lever is, when the key is turned in the locking direction, engaged within an opening formed at the end of the door so that the door is locked and the key is removable, luggage or a similar article is temporarily stored within the locker, the key is then inserted into the cylinder lock, the door becomes, when the key is then turned in the unlocking direction, openable, and the article stored within the locker is then removed, thereby completing one cycle of temporary article storage within the locker.

Most of the coin-operated lockers impose a rental fee. In this case, the deposited coin or coins are not returned. The locker which does not impose a rental fee returns the deposited coin or coins from a coin payout port when the temporary storage of an article is finished and the locker is unlocked.

Prior art with respect to a locking device for a coin-operated locker is disclosed, for example, in Japanese Patent Laid-open No. 207198/1983.

The general construction of the locking device will be described with reference to FIGS. 8 to 11.

A coin depositing port 2*a* is formed within a front wall 2 associated with the front face of a coin-operated locker frame 1, and a coin passage is formed between an inner frame 3 disposed parallel to the locker frame 1 and the locker frame 1.

A deflector 4 for preventing a coin of a size larger than a predetermined diameter from being deposited is provided at the top of the coin depositing port 2*a*.

An elevation lever 5 is elevationally movably provided upon the inner frame 3, and is lifted when the deposited coin contacts a pin 5*a* extending downwardly and protruding into the coin passage.

A small lever 7 and a driving lever 8 are pivotally secured to a pin 6 mounted upon the elevation lever 5, a pin 7*a* pivotally secured to the inner frame 3 protrudes from the small lever 7, and a protrusion piece 7*b* is formed at the top thereof.

A protrusion piece 8*a* is formed upon the driving lever 8, a slide cutout 8*b* is formed at the top of the lever 8 at the free end thereof, and a spring 9 extends between the protrusion 8*a* and the protrusion 7*b*.

A pin 10*a* of a coin selection lever 10 pivotally secured at an intermediate portion thereof to the inner frame 3 is disposed within the vicinity of the slide cutout 8*b*, and a pin 10*b* protruding into the coin passage is provided upon the left side of the coin selection lever 10.

When a coin C is inserted within the coin depositing port 2*a* of the coin-operated locker constructed as described above, the elevation lever 5 is lifted, the driving lever 8 is turned counterclockwise as seen in FIG. 8 so as to lift the pin 10*a*, the coin selection lever 10 is pivoted clockwise as seen in FIG. 8 so as to raise the pin 10*b* into the coin passage and thereby allow the coin C to pass. If the coin C has a diameter smaller than a predetermined diameter, the distance that the pin 10*b* is raised is short so as to prevent the coin C from passing (See FIG. 9).

A rotation stopping lever 11 pivotally secured at the intermediate portion thereof to the inner frame 3 is urged in the counterclockwise direction as seen in FIG. 8 by means of an engaging pin 11*a* to which one end of a spring 12 is connected, and is bent at the upper and lower ends thereof so as to be formed with a bent piece 11*b* and a slide piece 11*d* having a tapered surface 11*c*.

The rotation stopping lever 11 has an engaging pin 11*e* protruding into the coin passage, the coin C which passes through the coin passage being stopped by means of a drop stopping plate 19 to be described later so as to contact the engaging pin 11*e*.

The rotation stopping lever 11 contacted at its engaging pin 11*e* by means of the coin C is pivoted in the clockwise direction (See FIG. 9).

Reference numeral 13 denotes a locking cylinder lock. When the key is turned, a quick reverse lever 14 is rotated, but before the coin is deposited, the slide piece 11*d* protrudes into the rotating locus of the quick reverse lever 14 so as to prevent the quick reverse lever 14 from rotating, thereby disabling the lock mechanism of the locker to be locked.

When the coin C is engaged by means of the drop stopping plate 19, the coin C contacts the pin 11*e* so as to hold the rotation stopping lever 11 in a clockwisely rotated state. Thus, the slide piece 11*d* is held in a state outside of the rotating locus of the quick reverse lever 14, thereby enabling the locker to be locked.

The quick reverse lever 14 has a bent portion 14*a* at the lower end thereof, which is inserted into a groove 15*a* of a coin exhaust restriction piece 15.

The coin exhaust restriction piece 15 is pivotally secured at the center thereof to the locker frame 1, and is formed at the end opposite the groove 15*a* with a stopping piece 15*b* such that the stopping piece 15*b* protrudes into the coin passage when the quick reverse lever 14 is disposed at its locking position.

Therefore, when the cylinder lock 13 is locked by means of the key, the quick reverse lever 14 is rotated in the direction of the arrow R as shown in FIG. 11 so as to engage a locking lever 23 with an engaging opening (not shown) at the end of the door of the locker so as to lock the locker, and the quick reverse lever 14 pushes the tapered surface 11*c* of the slide piece 11*d* so as to rotate the rotation stopping lever 11. Thus, the bent piece 11*b* approaches the right lower end face of the coin selection lever 10 so as to stop the clockwise rotation of the coin selection lever 10, thereby preventing the coin from being erroneously deposited into the coin-operated locker which is already locked.

As the quick reverse lever 14 is rotated in the direction of the arrow R, the stopping piece 15*b* of the coin exhaust restriction piece 15 protrudes into the coin passage so as to stop the coin from being dropped from the drop stopping plate 19 to be described later during the stage of removing the key to be described later.

A rod 16 which protrudes rearwardly when inserting the key is provided within the cylinder lock 13, a groove 16*a* is formed at the rear end of the rod 16, one side of a rotary plate 17 is inserted into the groove 16*a*, and a pin 18 which intersects the groove 16*a* is inserted into an elongated opening 17*a* formed within the rotary plate 17.

An opening 17*b* to which a pin (not shown) secured to the inner frame 3 is pivotally secured and a pressing piece 17*c* are formed at the other side of the rotary plate 17, and the pressing piece 17*c* contacts the drop stopping plate 19 with the opening 17*b* serving as a fulcrum when the rod 16 protrudes rearwardly.

The drop stopping plate 19 is pivotally secured at one end thereof to a pivotal shaft 20 mounted upon the inner frame 3, is rotatably biased by means of a spring 21 mounted upon the pivotal shaft 20 serving as a fulcrum in a direction moving away from the inner frame 3, and is pressed toward the inner frame 3 when it is in contact with the pressing piece 17*c*. Thus, the end of an engaging pin 22 provided upon the drop stopping plate 19 protrudes into the coin passage so as to prevent the coin C from dropping (See FIG. 9).

The key rotated in the locking direction of the lock mechanism is then removable from the cylinder lock 13. When the key is removed, the rod 16 is moved in the direction of the cylinder lock 13, and the rotary plate 17 is rotated toward the cylinder lock 13 about the axis of the opening 17*b* serving as a fulcrum so that the pressing piece 17*c* is separated from the drop stopping plate 19. Thus, the drop stopping plate 19 is turned about the pivotal shaft 20 serving as a fulcrum so as to separate from the inner frame 3, the engaging pin 22 is removed from the coin passage, and the coin C previously stopped by means of the engaging pin 22 is dropped.

In the case of rental coin-operated locker which imposes a rental fee, the dropped coin or coins are introduced into a rental fee containing box.

In the case of a coin-operated locker which pays back the fee, the dropped coin or coins are dropped into the coin passage which communicates with the coin payout port 2*b* defined within the front wall 2, and rolled within the coin passage toward the coin payout port 2*b* so as to contact the stopping piece 15*b* protruding into the coin passage.

Thus, the coin-operated locker which has stored the article is locked, the client carries the key of the locker and moves away from within the vicinity of the locker.

When the client who has finished the temporary storage of the article inserts the key into the cylinder lock 13, the rod 16 protrudes rearwardly so as to rotate the rotary plate 17, and the pressing piece 17*c* forces the drop stopping plate 19 toward the inner frame 3.

Then, when the key is turned so as to unlock the cylinder lock 13, the quick reverse lever 14 is turned so as to depress the locking lever 23 so that the door becomes openable.

In the case of the coin-operated locker which pays back the fee, the coin exhaust restriction piece 15 is rotated as a result of the rotation of the quick reverse lever 14, and the stopping piece 15*b* is removed from the coin passage so as to discharge the coin from the coin payout port 2*b*.

Even in the case of both the rental and no charge coin-operated lockers, the rotation stopping lever 11 contacted at the tapered surface 11*c* thereof by means of the quick reverse lever 14 is rotated in the counterclockwise direction so as to be reset, the bent piece 11*b* is removed from the left lower side of the coin selection lever 10, and the coin selection lever 10 becomes rotatable so that the coin can be deposited into the coin depositing port 2*a* (See FIG. 10).

As described above, the use cycle of the coin-operated lock is completed.

The coin operated locker constructed and operated as described above might be wrongfully used as below, however, since the locker is always kept in a door openable state when the locker is not used.

(a) An unnecessary article which will not be missed even if it is stolen or for which it is difficult to find a disposing place is deposited within the locker, and the depositor leaves the vicinity of the locker while the locker remains unlocked hereby the locker is able to be used at no charge by means of an unrighteous person.

(b) In the case wherein a manager is lodged near the coin-operated locker, such as, for example, within the vicinity of a pool or a theater, the locker is wrongfully used without locking the same and at no charge due to the reason that there is less danger of the articles being stolen even if the locker is not locked.

If there is such a wrongful use of the coin-operated locker, a problem that a bona fide or payment user cannot use the locker arises.

Particularly when the locker which is limited in its time for use is unrighteously used for a long period of time, the aforenoted problem becomes great.

When there is a manager near the locker, if a theft occurs, the event affects the reputation of the manager who is responsible for the theft.

OBJECT OF THE INVENTION

An object of this invention is to provide a coin-operated locker which can solve the above-mentioned problems and drawbacks of the conventional coin-operated locker.

SUMMARY OF THE INVENTION

In order to achieve this and other objects, there is provided according to the present invention a coin-operated locker which is impossible to be opened when the locker is unused and which is openable at its door and becomes usable when a coin or coins of a predetermined amount are deposited within the lock mechanism, and which comprises, unlike in a conventional coin-operated locker, a sensor for detecting the deposit of a coin or coins, a detector for detecting the locking and the unlocking of a cylinder lock, a plunger engageable with or removable from the engaging opening of the door, and a controller for removing the plunger from the door in response to a coin deposit signal from the sensor and for engaging the plunger with the door after a predetermined time in response to the unlock signal from the detector.

Since the plunger is engaged within the engaging opening of the door until the coin or coins are deposited within the coin-operated lock mechanism of the locker having construction described above, the door is impossible to be opened, and an article cannot be improperly stored within the locker.

When the coin or coins are deposited, the plunger is separated from the door in response to the coin deposited signal from the sensor so as to allow the door to be opened, thereby enabling the article to be stored within the locker.

The locking operation of the cylinder lock of the locker is conducted similarly to that of the conventional coin-operated locker, and when the cylinder lock is unlocked after the article is temporarily stored within the locker, the plunger is again engaged with the door in response to the unlock signal from the detector after a predetermined time so that the door becomes impossible to open.

Since the above-mentioned predetermined time comprises a period sufficiently longer than the time required to remove the article from the locker after the locker is unlocked, the door of the locker becomes impossible to open after the locker is used, therby inhibiting the wrongful use of the locker thereafter.

BRIEF DESCRIPTION OF THE DRAWINGS

Other and further objects, features and advantages of the invention will become more fully apparent from the following description, when considered in connection with the accompanying drawings, in which like reference characters designate like or corresponding parts throughout the several views, and wherein.

DETAILED DESCRIPTION OF THE PREFERRED EMBODIMENTS

An embodiment of the present invention will be described in detail with reference to the accompanying drawings.

The coin operated locker of the present invention is derived by adding the following components and units to a conventional coin operated locker as shown in FIGS. 8 to 11 and which has already been discussed.

Figure 4A:
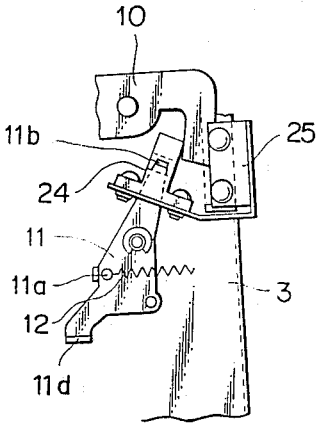
FIGS. 4*a* and 4*b* are front views of the essential portion of the coin mechanism showing the positional relationship between a rotation stopping lever and a photosensor.
Figure 4B:
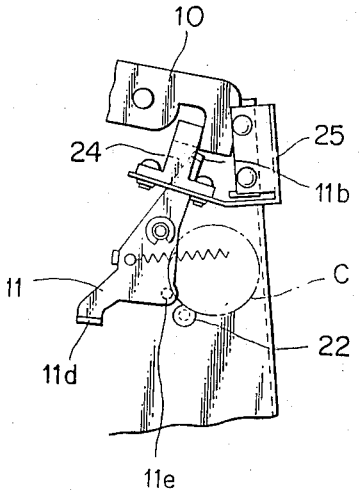
Figure 5:
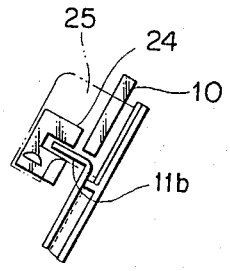
FIG. 5 is a side view of the essential portion of FIG. 4.

In FIGS. 4 and 5, reference numeral 24 denotes a photosensor for detecting the position of the bent piece 11*b* of the rotation stopping lever 11, which is attached to a supporting fitting 25 fixedly secured to the inner frame 3.

When the coin-operated locker is not used, the rotation stopping lever 11 is biased in the counterclockwise direction by means of spring 12 engaged with the engaging pin 11*a* of the lever 11, and the bent piece 11*b* is disposed at a position interrupting the light ray of the photosensor 24 as shown in FIG. 4(*a*).

When a coin or coins C are deposited within the lock mechanism of the locker, the coin C is prevented from dropping by means of the engaging pin 22 the rotating stopping lever 11 contacted by means of the coin C at the pin 11*e* thereof is rotated in the clockwise direction against the tension of the spring 12 so as to remove the bent piece 11*b* from the path of the light of the photosensor 24 as shown in FIG. 4(*b*), so that the photosensor 24 can detect the deposit of the coin.

In the embodiment described above, the deposit of the coin is detected by means of the photosensor 24. However, the present invention is not limited to the particular embodiment. For example, the movement of the rotation stopping lever 11 may be detected by means of another type of sensor, such as a microswitch or the like.

Figure 1:
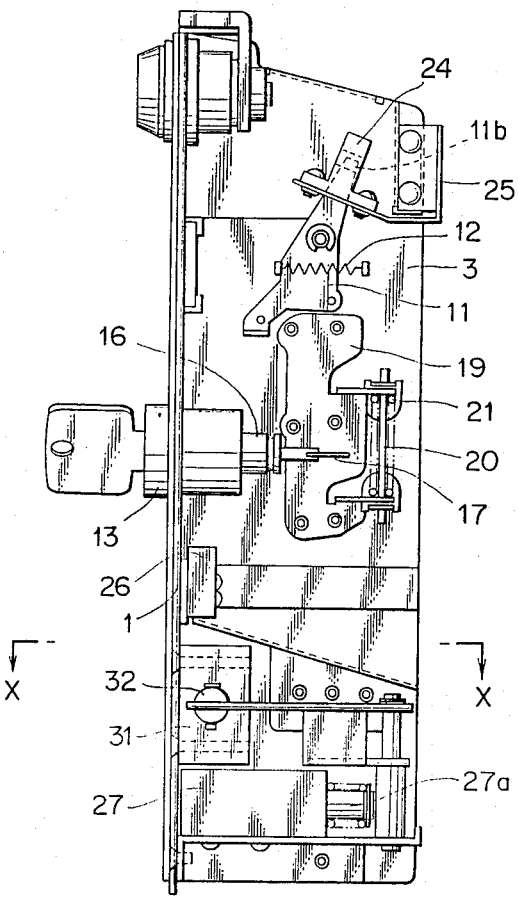
FIG. 1 is a side view showing the essential portion of a locking device in an embodiment of a coin-operated locker according to the present invention.
Figure 2:
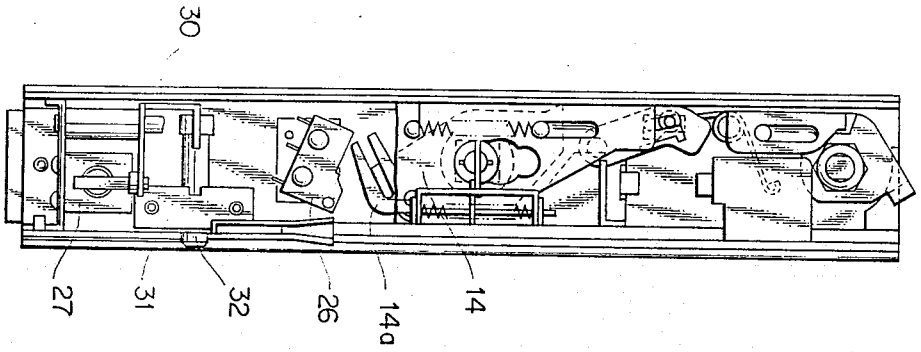
FIG. 2 is a front view showing the essential portion of the locking device.

As shown in FIGS. 1 and 2, a microswitch 26 is fixedly secured to the front wall 2 of the coin operated locker frame 1 beneath the bent part 14*a* of the quick reverse lever 14 which is rotated upon locking and unlocking of the cylinder lock 13 and which is detected by means of the microswitch 26.

In accordance with the conventional locking device, as shown in FIGS. 1 to 3*b*, a solenoid 27 is provided, a lever 28 is pivotally secured at one end thereof to the end of a core rod 27*a* of the solenoid 27, and a lever 30 is fixedly secured at one end thereof to a shaft 29 fixedly secured to the other end of the lever 28.

A plunger 32 slidably provided with respect to a bearing 31 is pivotally secured at the rear end thereof to the other end of the lever 30.

Figure 3A:
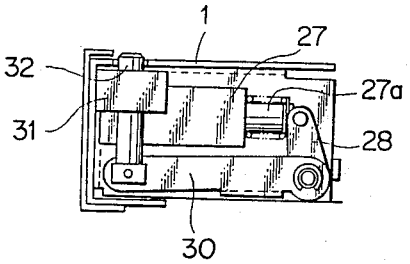
FIGS. 3*a* and 3*b* are sectional views of the embodiment along line X—X of FIG. 1 with FIGS. 3*a* and 3*b* showing the plunger mechanism in its retracted and extended states, respectively.

When the core rod 27*a* of the solenoid 27 is attracted, the core rod 27*a* is moved rearwardly into the solenoid 27 as shown in FIG. 3(*a*), and the plunger 32 is retracted into the locker frame 1. However, when the solenoid 27 is returned to its opposite state, the core rod 27*a* is projected so that the lever 28 and the lever 30 rotate about the shaft 29 serving as a fulcrum, thereby externally projecting the plunger 32 out of the locker frame 1.

Figure 6:
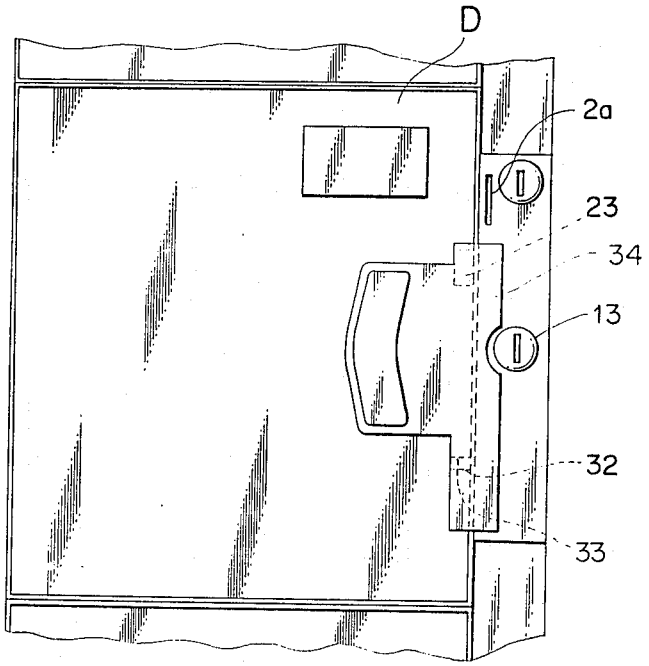
FIG. 6 is a front view of the coin-operated locker.

The protruding plunger 32 is, as shown in FIG. 6, engaged with an engaging opening 33 formed at the end of the door D so that the door D is impossible to open.

Reference numeral 34 denotes a grip of the door D.

A plurality of the coin-operated lockers are disposed horizontally in rows, and a plurality of the rows of the coin-operated lockers are stacked elevationally. Thus, the solenoids 27, the photosensors 24 and the microswitches 26 of the respective lockers are electrically connected to a controller which has a CPU substrate.

The remaining structure of the coin-operated locker of the invention is constructed similarly to that of the conventional example shown in FIGS. 8 to 11.

The operation of the coin-operated locker constructed as described above will now be described in detail with reference to the flowchart of FIG. 7.

Figure 7:
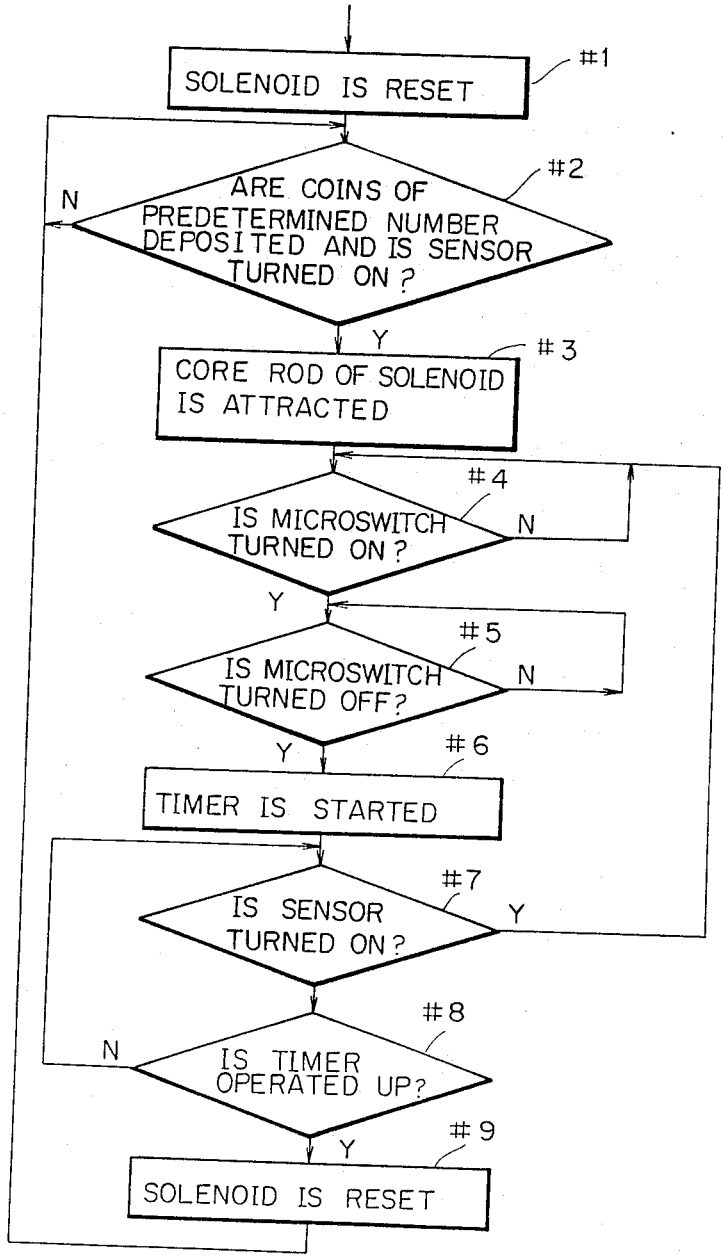
FIG. 7 is a flowchart of the operation of the locker.
Figure 8:
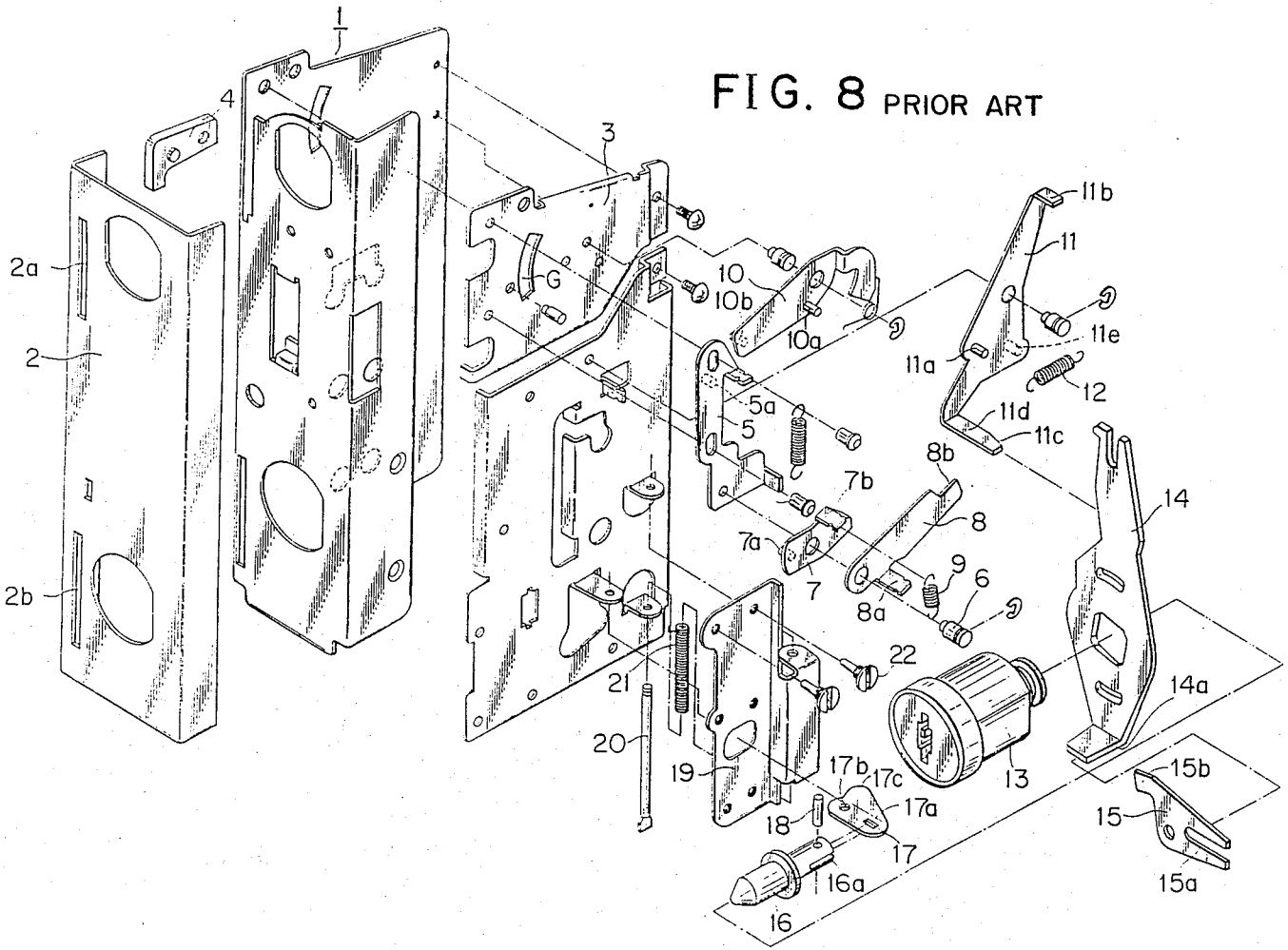
FIG. 8 PRIOR ART
FIG. 8 is a perspective exploded view of the essential components of a conventional locking device.
Figure 9:
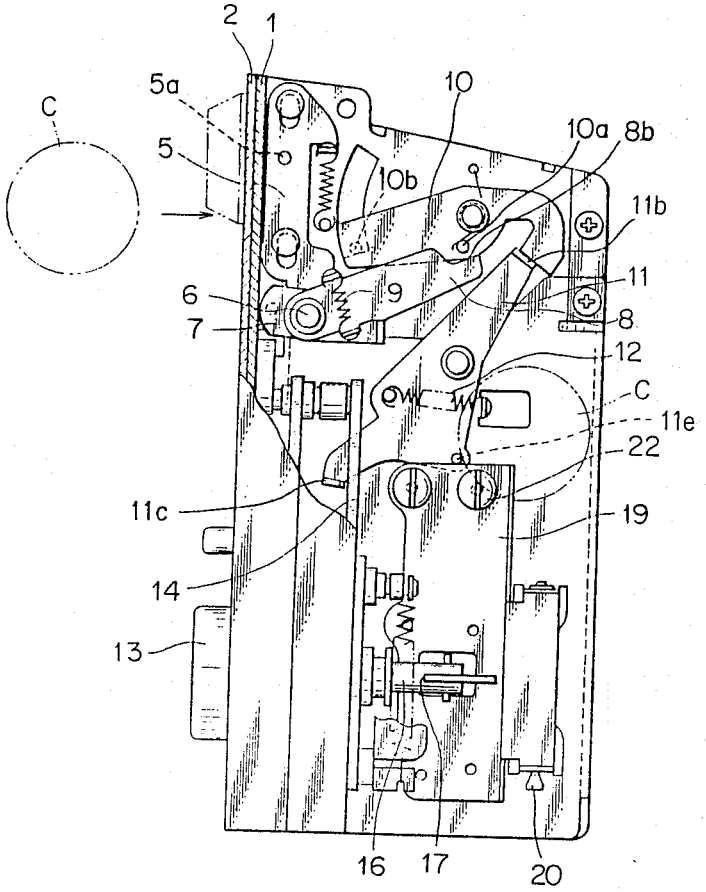
FIG. 9 PRIOR ART
FIG. 9 is a side view of the essential portion of the conventional locking device illustrating the state after the coin or coins are deposited.
Figure 10:
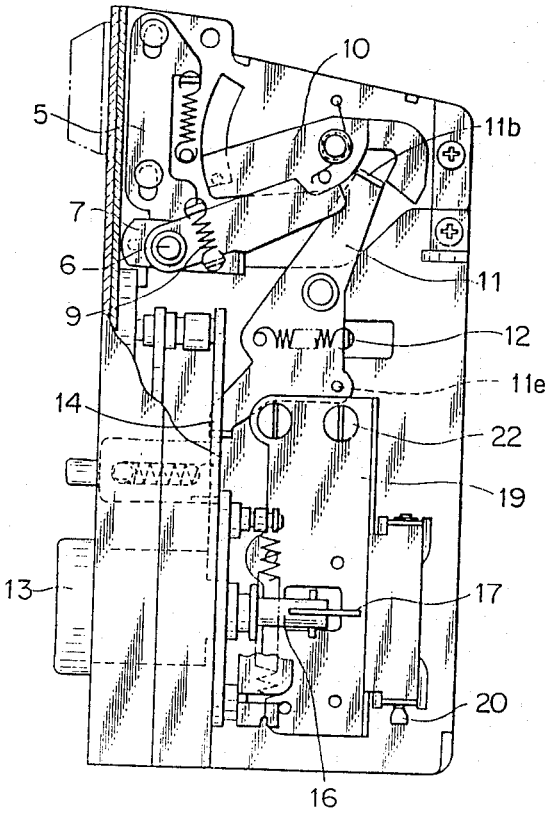
FIG. 10 PRIOR ART
FIG. 10 is a side view of the essential portion of the conventional locking device illustrating the state when the coin is not deposited.
Figure 11:
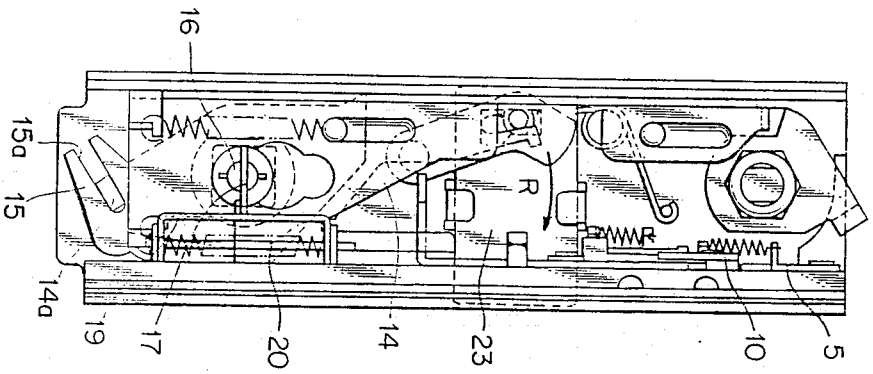
FIG. 11 PRIOR ART
FIG. 11 is a front view of the essential portion of the conventional locking device.

The number of steps illustrated in the flowchart of FIG. 7 is designated by #.

Unused Time

The cylinder lock 13 may be moved to an unlocking state, but since the solenoid 27 is reset, the plunger 32 is engaged within the door D so that the door D is impossible to open (#1).

The rotation stopping lever 11 is disposed at the position interrupting the light of the photosensor 24 as shown in FIG. 4*a*.

Use of Coin-operated locker

When a coin or coins C of a predetermined amount are deposited within the coin depositing port 2*a*, the coin C contacts the engaging pin 22 as a result of moving through the coin passage, the rotation stopping lever 11 contacted at the pin 11*e* by means of the coin C is rotated in the clockwise direction so that the bent piece 11*b* is removed from the light path of the photosensor 24, with the result that the photosensor 24 is turned ON (#2).

If the photosensor 24 is not turned ON, the operation is the same as before step #2.

When the photosensor 24 is turned ON, the solenoid 27 is attracted, the core rod 27*a* is moved rearwardly within the solenoid 27, and the plunger 32 is separated from the engaging opening 33 of the door D so that the door D becomes openable (#3).

Since the locking device of the coin-operated locker is constructed and operated in the same manner as those of the conventional ones, the locking operation becomes possible by depositing the coin or coins within the lock mechanism of the locker, luggage or an article is stored within the locker, and the cylinder lock 13 is then locked by means of the key.

When the quick reverse lever 14 is rotated together with the cylinder lock 13 in the locking direction, the microswitch 26 is turned ON by means of the moving bent portion 14*a* (#4).

If the microswitch 26 is not turned ON, the operation is the same as before step #4.

The client who removed the key after the locker is locked carries the key and departs from the vicinity of the locker.

When the key is removed, the coin or coins C are dropped so as to be deposited within the fee containing box within the rental coin-operated locker, while the coin or coins C are rolled within the coin passage so as to be engaged with the stopping piece 15*b* protruding into the coin passage within the no charge coin-operated locker.

When the client, who returns to remove the temporarily stored article from the locker, inserts the key into the cylinder lock 13 and then turns the key in the unlocking direction, the locking rod 16 is retracted so that the door becomes openable, and the coin or coins C are exhausted toward the coin payout port 2*b* within the no charge coin-operated locker.

The quick reverse lever 14 is rotated further in the unlocking direction so that the bent portion 14*a* is separated from the microswitch 26 with the result that the microswitch 26 is turned OFF (#5).

If the microswitch 26 is not turned OFF, the operation is the same as before step #5.

When the microswitch 26 is turned OFF, a timer is operated (#6).

Since the coin C is already dropped from the engaging pin 22, the rotation stopping lever 11 is returned to the state as shown in FIG. 4(*a*), and the photosensor 24 interrupted by means of the bent piece 11*b* is turned OFF.

Figure 3B:
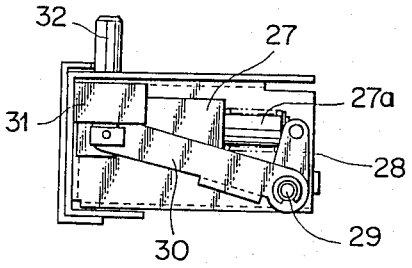

Therefore, when the fact that the photosensor 24 is not 0N is confirmed (#7), the timer is operated (#8), and the solenoid 27 is then returned to the state shown in FIG. 3*b* (#9).

When a coin or coins C are deposited within the coin depositing port 2*a* by means of a subsequent client before the timer is timed out after the timer is started (#6), the rotation stopping lever 11 is moved to the state as shown in FIG. 4(*b*) so that the photosensor 24 is turned ON. Thus, the operation is returned from step #7 to before step #4, and the coin-operated locker becomes usable as it is.

In step #9, when the solenoid 27 is returned to the state of FIG. 3*b*, the plunger 32 is engaged within the engaging opening 33 of the door D so that the door D becomes impossible to open.

Therefore, the coin operated locker which may be desired to conventionally be used wrongfully is locked so that the door is impossible to open so as to inhibit the unrighteous use of the locker and the locker is returned to the step before step #2 so as to wait for the next guest.

The coin-operated locker of the present invention provides means, for limiting the opening of the door of the locker, within the locking device thereof and the controller for simultaneously controlling the units of the respective coin-operated lockers. Consequently, the coin-operated locker which may ordinarily be wrongfully used is disabled so that the door cannot open, thereby eliminating the unrighteous use of the locker and enabling the locker to impose the rental fee before the article is stored within the locker.

Obviously, many modifications and variations of the present invention are possible in light of the above teachings. It is therefore to be understood that within the scope of the appended claims, the present invention may be practiced otherwise than as specifically described herein.

What is claimed is:

1. A coin-operated locking system for use in connection with the locking and unlocking of a closure movable mounted upon a support frame, comprising:

first locking means movable between first locked and second unlocked position for locking and unlocking, respectively, said closure relative to said support frame;

detector means for detecting said first locked and second unlocked positions of said first locking means, and for generating a first signal in response to detection of said first locking means disposed at said second unlocked position;

second locking means movable between first locked and second unlocked positions for locking and unlocking, respectively, said closure relative to said support frame;

sensor means for sensing the deposition of a predetermined amount of coins within said locking system and for generating a second signal in response to said sensing of said deposition of said coins within said locking system for moving said second locking means to said second unlocked position; and timer means, responsive to said first signal of said detector means, for generating a third signal for moving said second locking means to said first locked position at a predetermined time after receiving said first signal from said detector means indicating that said first locking means is disposed at said second unlocked position.

2. A system as set forth in claim 1, wherein:

said support frame is a component part of a storage locker; and said closure is a door pivotably mounted upon said storage locker.

3. A system as set forth in claim 1, wherein:

said first locking means comprises a manually-operated rotary lock cylinder.

4. A system as set forth in claim 1, wherein:

said second locking means comprises a solenoid-actuated plunger.

5. A system as set forth in claim 1, wherein:

said sensor means comprises a photosensor.

6. A system as set forth in claim 1 wherein:

said detector means comprises a proximity micro-switch.

7. A coin-operated locking system for use in connection with the locking and unlocking of a door pivotably mounted upon an article storage locker, comprising:

first manually-operated cylinder-type rotary key locking means movable between a first locked position and a second unlocked position for locking and unlocking, respectively, said door relative to said storage locker;

proximity detector means for detecting the disposition of said first locking means at one of said first locked and second unlocked position, and for generating a first signal in response to detection of said first locking means at said second unlocked position;

second solenoid-actuated plunger-type locking means movable between first locked and second unlocked position for locking and unlocking, respectively, said door relative to said storage locker;

photosensor means for sensing the deposition of a predetermined amount of coins within said locking system and for generating a second electrical signal in response to said sensing of said deposition of said coins within said locking system for moving said plunger-type locking means to said second unlocked position; and timer means, responsive to said first signal of said detector means, for generating a third electrical signal for moving said plunger-type locking means to said first locked position at a predetermined time after receiving said first signal from said detector means indicating that said first locking means is disposed at said second unlocked position.

* * * * *